US007531217B2

(12) United States Patent
Gleeson et al.

(10) Patent No.: US 7,531,217 B2
(45) Date of Patent: May 12, 2009

(54) METHODS FOR MAKING HIGH-TEMPERATURE COATINGS HAVING PT METAL MODIFIED γ-NI +γ'-$NI_3$AL ALLOY COMPOSITIONS AND A REACTIVE ELEMENT

(75) Inventors: Brian Gleeson, Ames, IA (US); Bingtao Li, Ames, IA (US); Daniel J. Sordelet, Ames, IA (US); William John Brindley, Indianapolis, IN (US)

(73) Assignees: Iowa State University Research Foundation, Inc., Ames, IA (US); Rolls-Royce Corporation, Indianapolis, IN (US)

( * ) Notice: Subject to any disclaimer, the term of this patent is extended or adjusted under 35 U.S.C. 154(b) by 21 days.

(21) Appl. No.: 11/012,873

(22) Filed: Dec. 15, 2004

(65) Prior Publication Data

US 2006/0127695 A1 Jun. 15, 2006

(51) Int. Cl.
*B32B 15/01* (2006.01)
*C03C 27/02* (2006.01)

(52) U.S. Cl. ..... 427/328; 427/327; 427/405; 427/304; 427/305; 427/319; 427/383.7

(58) Field of Classification Search ..... 427/327, 427/328, 404, 405, 318, 319, 304, 305, 383.1, 427/383.3, 383.7
See application file for complete search history.

(56) References Cited

U.S. PATENT DOCUMENTS

| | | | |
|---|---|---|---|
| 3,933,483 | A | 1/1976 | Komatsu et al. |
| 4,019,900 | A | 4/1977 | Raghavan et al. |
| 4,123,594 | A | 10/1978 | Chang |
| 4,123,595 | A | 10/1978 | Chang |
| 4,392,894 | A | 7/1983 | Pearson et al. |
| 4,743,514 | A | 5/1988 | Strangman et al. |
| 5,435,861 | A | 7/1995 | Khan et al. |
| 5,514,482 | A | 5/1996 | Strangman |
| 5,667,663 | A | 9/1997 | Rickerby et al. |

(Continued)

FOREIGN PATENT DOCUMENTS

| | | |
|---|---|---|
| EP | 0718420 | 6/1996 |

(Continued)

OTHER PUBLICATIONS

V.K. Tolpygo and D.R. Clarke, "Microstructural study of the theta-alpha tranformation in alumina scales formed on nickel-aluminides," *Materials at High Temperatures*, vol. 17, No. 1, pp. 59-70 (2000), no month.

(Continued)

*Primary Examiner*—John J. Zimmerman
*Assistant Examiner*—Aaron Austin
(74) *Attorney, Agent, or Firm*—Shumaker & Sieffert, P.A.

(57) ABSTRACT

A method for making an oxidation resistant article, including (a) depositing a layer of a Pt group metal on a substrate to form a platinized substrate; and (b) depositing on the platinized substrate layer of Pt group metal a layer of a reactive element selected from the group consisting of Hf, Y, La, Ce and Zr and combinations thereof to form a surface modified region thereon, wherein the surface modified region includes the Pt-group metal, Ni, Al and the reactive element in relative concentration to provide a γ-Ni+γ'-Ni3Al phase constitution.

51 Claims, 14 Drawing Sheets

Portion of 1100° C Ni-Al-Pt Phase Diagram

U.S. PATENT DOCUMENTS

| | | | | |
|---|---|---|---|---|
| 5,763,107 | A * | 6/1998 | Rickerby et al. | 428/623 |
| 5,981,091 | A | 11/1999 | Rickerby et al. | |
| 6,306,524 | B1 | 10/2001 | Spitsberg et al. | |
| 6,436,473 | B2 * | 8/2002 | Darolia et al. | 427/252 |
| 6,485,844 | B1 | 11/2002 | Strangman et al. | |
| 6,554,920 | B1 | 4/2003 | Jackson et al. | |
| 7,229,701 | B2 | 6/2007 | Madhava et al. | |
| 7,316,850 | B2 | 1/2008 | Hu et al. | |
| 2002/0009611 | A1 * | 1/2002 | Darolia et al. | 428/680 |
| 2002/0132132 | A1 | 9/2002 | Bose et al. | |
| 2004/0229075 | A1 | 11/2004 | Gleeson et al. | |
| 2005/0003227 | A1 | 1/2005 | Khan et al. | |
| 2006/0093752 | A1 * | 5/2006 | Darolia et al. | 427/523 |
| 2006/0093801 | A1 | 5/2006 | Darolia et al. | |
| 2006/0093850 | A1 | 5/2006 | Darolia et al. | |
| 2006/0093851 | A1 | 5/2006 | Darolia et al. | |
| 2006/0292390 | A1 | 12/2006 | Kassner et al. | |
| 2007/0071995 | A1 | 3/2007 | Hazel et al. | |
| 2007/0071996 | A1 | 3/2007 | Hazel et al. | |

FOREIGN PATENT DOCUMENTS

| | | | |
|---|---|---|---|
| EP | 1 321 541 | A2 | 6/2003 |
| EP | 1327702 | A1 | 7/2003 |
| WO | WO 01/75192 | A2 | 10/2001 |
| WO | WO 2007/008227 | A2 | 1/2007 |

OTHER PUBLICATIONS

J.A. Haynes, B.A. Pint, W.D. Porter and I.G. Wright, "Comparison of thermal expansion and oxidation behavior of various high-temperature coating materials and superalloys," *Materials at High Temperatures*, vol. 21, No. 2, pp. 87-94 (2004), no month.

Leyens et al., "R&D Status and Needs for Improved EB-PVD Thermal Barrier Coating Performance," *Mat. Res. Soc. Symp. Proc.*, 2001, vol. 645E, pp. M10.1.1-M10.1.12, no month.

Peters et al., "EB-PVD Thermal Barrier Coatings for Aeroengines and Gas Turbines," *Advanced Engineering Materials*, 2001, 3(4):193-204, no month.

Notification of Transmittal of the International Search Report and the Written Opinion of the International Searching Authority for corresponding patent application No. PCT/US2005/045927, mailed Jul. 19, 2006, 11 pages.

Murakami et al., "Distribution of Platinum Group Metals in Ni-Base Single-Crystal Superalloys", Supperalloys Proceedings International Symposium Superalloys, Sep. 17, 2000, pp. 747-756; XP009057026.

Reid et al., "Microstructural Transformations in Platinum Aluminide Coated CMSX-4 Superalloy", Materials Science Forum vols. 461-464, pp. 343-350, (2004), XP009077214, no month.

Gobel et al., "Interdiffusion between the platinum-modified aluminide coating RT 22 and nickel-based single-crystal superalloys at 1000 and 1200° C", Materials at High Temperatures, vol. 12, No. 4, pp. 301-309, (1994), XP009077277, no month.

Chen et al., "Degradation of the platinum aluminide coating on CMSX4 at 1100° C", Surface & Coatings Technology, vol. 92, pp. 69-77, (1997), XP-002416853, no month.

U.S. Appl. No. 11/744,633, filed May 4, 2007, (Continuation of U.S. Appl. No. 11/012,873).

U.S. Appl. No. 11/744,675, filed May 4, 2007, (Continuation of U.S. Appl. No. 10/439,649).

U.S. Appl. No. 11/744,622, filed May 4, 2007, (Continuation of U.S. Appl. No. 10/439,649).

U.S. Appl. No. 11/744,401, filed May 4, 2007, (Continuation of U.S. Appl. No. 10/439,649).

U.S. Appl. No. 11/744,634, filed May 4, 2007, (Continuation of U.S. Appl. No. 10/439,649).

U.S. Appl. No. 11/744,433, filed May 4, 2007, (Continuation of U.S. Appl. No. 11/206,663).

U.S. Appl. No. 11/744,453, filed May 4, 2007, (Continuation of U.S. Appl. No. 11/206,663).

U.S. Appl. No. 11/744,658, filed May 4, 2007, (Continuation of U.S. Appl. No. 11/206,663).

U.S. Appl. No. 11/744,653, filed May 4, 2007, (Continuation of U.S. Appl. No. 11/206,663).

International Preliminary Examination Report from corresponding PCT Application Serial No. PCT/US05/045927 mailed Apr. 4, 2007 (28 pages).

International Preliminary Examination Report from PCT Application Serial No. PCT/US04/014740, mailed Dec. 1, 2005, 7 pages.

International Preliminary Examination Report from PCT Application Serial No. PCT/US05/029493, mailed Jun. 21, 2007, 7 pages.

Communication pursuant to Article 96(2) EPC, dated Jan. 17, 2008, for EP application No. 05 858 389.9 from the European Patent Office, (3 pages).

N. Vialas and D. Monceau, "Effect of Pt and A1 content on the long-term, high temperature oxidation behavior and interdiffusion of a Pt-modified aluminide coating deposited on Ni-base superalloys", Surface & Coatings Technology, 201, (2006) pp. 3846-3851 (September).

S. Hayashi et al., "Interdiffusion Behavior of Pt-Modified $\gamma$-Ni+$\gamma'$-$Ni_3A1$ Alloys Coupled to Ni-A1-Based Alloys", Metallurgical and Materials Transactions A, vol. 36A Jul. 2005, pp. 1796-1775.

Office Action dated Mar. 19, 2008, for U.S. Appl. No. 11/206,663, (27 pages).

Communication pursuant to Article 96(2) EPC dated Oct. 12, 2007 for counterpart EP application No. 05 857 130.8 from the European Patent Office, (3 pages).

Communication pursuant to Article 96(2) EPC, dated Jun. 11, 2007, for EP application No. 05 858 389.9 from the European Patent Office, (3 pages).

U.S. Appl. No. 11/893,576, filed Aug. 16, 2007, entitled "High Temperature Coatings with Pt Metal Modified $\gamma$-Ni+$\gamma'$-$Ni_3A1$ Alloy Compostions", Gleeson et al.

Peggy Y. Hou, "Impurity Effects on Alumina Scale Growth", Journal of Am. Ceram. Soc., vol. 86, No. 4, 2003, pp. 660-668.

B. A. Pint et al., "Grain Boundary Segregation of Cation Dopants in $\alpha$-$A1_2O_3$ Scales", Journal of Electrochem. Soc., vol. 145, No. 6, Jun. 1998, pp. 1819-1829.

Tresa M. Pollock et al., "Nickel-Based Superalloys for Advanced Turbine Engines: Chemistry, Microstructure, and Properties", Journal of Propulsion and Power, vol. 22, No. 2, Mar.-Apr. 2006, pp. 361-377.

Roger C. Reed, "The Superalloys Fundamentals and Applications", Cambridge University Press, 2006, (7 pages).

* cited by examiner

Oxidation Result of Coated CMSX-4 for 1000 h at 1150°C

Deposition of Pt+Hf-modified $\gamma'+\gamma$ Coating on CMSX-4

NiAlPtHf Coating on CMSX-10

ISU Coating on René-N5 Pin

METHODS FOR MAKING HIGH-TEMPERATURE COATINGS HAVING PT METAL MODIFIED γ-NI +γ'-$NI_3$AL ALLOY COMPOSITIONS AND A REACTIVE ELEMENT

TECHNICAL FIELD

This invention relates to methods for depositing alloy compositions for high-temperature, oxidation resistant coatings. Coatings based on these alloy compositions may be used alone or, for example, as part of a thermal barrier system for components in high-temperature systems.

BACKGROUND

The components of high-temperature mechanical systems, such as, for example, gas-turbine engines, must operate in severe environments. For example, the high-pressure turbine blades and vanes exposed to hot gases in commercial aeronautical engines typically experience metal surface temperatures of about 900-1000° C., with short-term peaks as high as 1150° C. A portion of a typical metallic article 10 used in a high-temperature mechanical system is shown in FIG. 1. The blade 10 includes a Ni or Co-based superalloy substrate 12 coated with a thermal barrier coating (TBC) 14. The thermal barrier coating 14 includes a thermally insulative ceramic topcoat 20 and an underlying metallic bond coat 16. The topcoat 20, usually applied either by air plasma spraying or electron beam physical vapor deposition, is currently most often a layer of yttria-stabilized zirconia (YSZ) with a thickness of about 300-600 μm. The properties of YSZ include low thermal conductivity, high oxygen permeability, and a relatively high coefficient of thermal expansion (CTE). The YSZ topcoat 20 is also made "strain tolerant" by depositing a structure that contains numerous pores and/or pathways. The consequently high oxygen permeability of the YSZ topcoat 20 imposes the constraint that the metallic bond coat 16 must be resistant to oxidation attack. The bond coat 16 is therefore sufficiently rich in Al to form a layer 18 of a protective thermally grown oxide (TGO) scale of $Al_2O_3$. In addition to imparting oxidation resistance, the TGO bonds the ceramic topcoat 20 to the substrate 12 and bond coat 16.

The adhesion and mechanical integrity of the TGO scale layer 18 is very dependent on the composition and structure of the bond coat 16. Ideally, when exposed to high temperatures, the bond coat 16 should oxidize to form a slow-growing, non-porous TGO scale that adheres well to the superalloy substrate 12. Conventional bond coats 16 are typically either (i) an MCrAlY overlay (where M=Ni, Co, NiCo, or Fe) having a β-NiAl+γ-Ni phase constitution or (ii) a platinum-modified diffusion aluminide having a β-NiAl phase constitution. The Al content in either of these types of coatings is sufficiently high that the $Al_2O_3$ scale layer 18 can "re-heal" following repeated spalling during service of the turbine component.

However, as a result of this Al enriched composition and the predominance of the β-NiAl in the coating microstructure, these coatings are not compatible with the phase constitution of the Ni-based superalloy substrates, which have a gamma-Ni phase and a gamma prime-$Ni_3Al$ (referred to herein as γ-Ni+γ'-$Ni_3Al$ or γ+γ') microstructure. When applied to a superalloy substrate having a γ-Ni+γ'-$Ni_3Al$ microstructure, Al diffuses from the coating layer to the substrate. This Al interdiffusion depletes Al in the coating layer, which reduces the ability of the coating to sustain $Al_2O_3$ scale growth. Additional diffusion also introduces unwanted phase changes and elements that can promote oxide scale spallation. A further drawback of β-NiAl-based coatings is incompatibility with the γ-Ni+γ'-$Ni_3Al$-based substrate due to CTE differences.

Another approach to depositing a protective coating on a γ-Ni+γ'-$Ni_3Al$-based metallic article 28, described in U.S. Pat. Nos. 5,667,663 and 5,981,091 to Rickerby et al., is shown in FIG. 2A. A superalloy substrate 30 is coated on an outer surface with a layer 32 of Pt and then heat-treated. Referring to FIG. 2B, during this heat treatment, interdiffusion occurs, which includes the diffusion of Al from the superalloy substrate 30 into the Pt layer 32 to form an Al-enriched Pt-modified outer surface region 34 on the superalloy substrate (FIG. 2B). An $Al_2O_3$ TGO scale layer 38 may then form on the surface-modified region 34 and a ceramic layer topcoat 40 may also be deposited using conventional techniques. However, since transition metals from the superalloy substrate 30 are also present in the surface modified region 34, it is difficult to precisely control the composition and phase constitution of the surface region 34 to provide optimum properties to improve adhesion of the TGO scale layer 38. Rickerby et al. further suggest that this platinizing and heat treatment process may include the incorporation up to 0.8 wt % of Hf or Y into the platinum-enriched surface layer, but no specific deposition methods or pack compositions were provided to achieve this surface layer composition.

Copending application U.S. Ser. No. 10/439,649, incorporated herein by reference, describes alloy compositions suitable for bond coat applications. The alloys include a Pt-group metal, Ni and Al in relative concentration to provide a γ+γ' phase constitution, with γ referring to the solid-solution Ni phase and γ' referring to the solid-solution $Ni_3Al$ phase. In these alloys, a Pt-group metal, Ni and Al, are present, and the concentration of Al is limited with respect to the concentrations of Ni and the Pt-group metal such that the alloy includes substantially no β-NiAl phase. These alloys are shown in the region A in FIG. 3.

Preferably, the ternary Ni-Al-Pt alloy in the copending '649 application includes less than about 23 at % Al, about 10 at % to about 30 at % of a Pt-group metal, preferably Pt, and the remainder Ni. Additional reactive elements such as Hf, Y, La, Ce and Zr, or combinations thereof, may optionally be added to or present in the ternary Pt-group metal modified γ-Ni+γ'-$Ni_3Al$ alloy and/or improve its properties. The addition of such reactive elements tends to stabilize the γ' phase. Therefore, if sufficient reactive metal is added to the composition, the resulting phase constitution may be predominately γ' or solely γ'. The Pt-group metal modified γ-Ni+γ'-$Ni_3Al$ alloy exhibits excellent solubility for reactive elements compared to conventional β-NiAl-based alloys, and in the '649 application the reactive elements may be added to the γ+γ' alloy at a concentration of up to about 2 at % (~4 wt %). A preferred reactive element is Hf. In addition, other typical superalloy substrate constituents such as, for example, Cr, Co, Mo, Ta, and Re, and combinations thereof, may optionally be added to or present in the Pt-group metal modified γ-Ni+γ'-$Ni_3Al$ alloy in any concentration to the extent that a γ+γ' phase constitution predominates.

The Pt-group metal modified alloys have a γ-Ni+γ'-$Ni_3Al$ phase constitution that is both chemically, physically and mechanically compatible with the γ+γ' microstructure of a typical Ni-based superalloy substrate. Protective coatings formulated from these alloys will have coefficients of thermal expansion (CTE) that are more compatible with the CTEs of Ni-based superalloys than the CTEs of β-NiAl-based coatings. The former provides enhanced coating stability during the repeated and severe thermal cycles experienced by mechanical components in high-temperature mechanical systems.

When thermally oxidized, the Pt-group metal modified γ-Ni+γ'-$Ni_3Al$ alloy coatings grow an α-$Al_2O_3$ scale layer at a rate comparable to or slower than the thermally grown scale layers produced by conventional β-NiAl-Pt bond coat systems, and this provides excellent oxidation resistance for γ-Ni+γ'-$Ni_3Al$ alloy compositions. When the Pt-metal modified γ+γ' alloys further modified with a reactive element such as, for example, Hf, and applied on a superalloy substrate as a coating, the growth of the TGO scale layer is even slower than comparable coating compositions without Hf addition. After prolonged thermal exposure, the TGO scale layer further appears more planar and has enhanced adhesion on the coating layer compared to scale layers formed from conventional β-NiAl-Pt coatings.

In addition, the thermodynamic activity of Al in the Pt-group metal modified K-Ni+K'-$Ni_3Al$ alloys can, with sufficient Pt content, decrease to a level below that of the Al in Ni-based superalloy substrates. When such a Pt-group metal modified γ-Ni+γ'-$Ni_3Al$ alloy coating is applied on a superalloy substrate, this variation in thermodynamic activity causes Al to diffuse up its concentration gradient from the superalloy substrate into the coating. Such "uphill diffusion" reduces and/or substantially eliminates Al depletion from the coating. This reduces spallation in the scale layer, increases the long-term stability of the coating and scale layers, and would greatly enhance the reliability and durability of a thermal barrier coating system.

The Pt-group metal modified K-Ni+K'-$Ni_3Al$ alloy may be applied to a superalloy substrate using any known process, including for example, plasma spraying, chemical vapor deposition (CVD), physical vapor deposition (PVD) and sputtering to create a coating and form a temperature-resistant article. Typically this deposition step is performed under non- or minimal oxidizing conditions.

As described earlier, when the Pt-group metal modified γ+γ' alloys described in the '649 application are formulated with other reactive elements such as, for example, Hf, and applied on a superalloy substrate as a coating, the growth of the TGO scale layer is even slower than comparable coating compositions without Hf addition. After prolonged thermal exposure, the TGO scale layer further appears more planar and has enhanced adhesion on the coating layer compared to scale layers formed from conventional β-NiAl-Pt bond coat materials. As such, inclusion of a reactive element in the Pt-metal modified γ+γ' alloys described in the '649 application is highly desirable.

SUMMARY

As noted above, Rickerby et al. suggest that the reactive element Hf may be added to a Pt-metal modified γ+γ' alloys at a level of up to 0.8 wt %, but providing a surface layer with a desired reactive element concentration has proved difficult. The reason for this is that the nearly complete partitioning of a reactive element such as Hf to the γ' phase necessitates that γ' be the principal phase during the deposition process to enrich the surface with Hf.

In one aspect, the invention is a method for making an oxidation resistant article, including (a) depositing a layer of a Pt group metal on a substrate to form a platinized substrate; and (b) depositing on the platinized substrate a reactive element selected from the group consisting of Hf, Y, La, Ce and Zr and combinations thereof to form a surface modified region thereon, wherein the surface-modified region comprises the Pt-group metal, Ni, Al and the reactive element in relative concentration to provide a γ-Ni+γ'-$Ni_3Al$ phase constitution.

In preferred embodiments of this method, the surface modified region comprises greater than 0.8 wt % and less than 5 wt % of the reactive element. A preferred reactive element is Hf.

In another aspect, the invention is a method of making a temperature resistant article, including (a) depositing a layer of Pt on a superalloy substrate to form a platinized substrate; (b) heat treating the platinized substrate; and (c) depositing from a pack onto the platinized substrate to form a surface modified region thereon, wherein the pack comprises sufficient Hf such that the surface modified region includes Pt, Ni, Hf and Al in relative concentration to provide a γ-Ni+γ'-$Ni_3Al$ phase constitution, and wherein the surface-modified region includes greater than 0.8 wt % and less than 5 wt % Hf.

In yet another aspect, the invention is a heat resistant article including a superalloy with a surface region including a reactive element selected from the group consisting of Hf, Y, La, Ce and Zr and combinations thereof, wherein the surface region includes a Pt-group metal, Ni, Al and the reactive element in relative concentration to provide a K-Ni+K'-$Ni_3Al$ phase constitution.

The Pt+reactive element-modified γ-Ni+γ'-$Ni_3Al$ coatings described herein have a number advantages over conventional β-NiAl containing coatings, including: (1) compatibility with the Ni-based superalloy substrate in terms of phase constitution and thermal expansion behavior; (2) no performance limiting phase transformations in the coating layer (i.e., destabilization of β to martensite or γ') or in the coating/substrate interdiffusion zone (i.e., formation of brittle topologically close-packed (TCP) phases such as sigma); (3) the existence of a chemical driving force for the Al to diffuse up its concentration gradient from the substrate to the coating; (4) and exceptionally low TGO scale growth kinetics due, in part, to the presence of a preferred reactive element content of 0.8-5 wt %. Stemming from these advantages is the further advantage that the Pt+reactive metal-modified γ-Ni+γ'-$Ni_3Al$ coatings do not have to be as thick as the conventional β-NiAl containing coatings to provide a performance advantage.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

In one aspect, the invention is a method for making an oxidation resistant article that includes an oxidation resistant region on a substrate, typically a superalloy substrate. The oxidation resistant alloy layer includes a modified K-Ni+K'-$Ni_3Al$ alloy containing a Pt-group metal, Ni, Al and a reactive element in relative concentration such that a K-Ni+K'-$Ni_3Al$ phase constitution results; although, stabilization effects by certain elements may cause γ'-$Ni_3Al$ to be the sole phase. In this alloy the concentration of Al is limited with respect to the concentration of Ni, the Pt-group metal and the reactive element such that substantially no θ-NiAl phase, preferably no θ-NiAl phase, is present in the alloy, and the K-Ni+K'-$Ni_3Al$ phase structure predominates.

The reactive element(s) in the oxidation resistant region tend not to oxidize even though their oxides are more stable than $Al_2O_3$. While not wishing to be bound by any theory, this is apparently because Pt acts to decrease the thermodynamic activity of Hf and Zr in the γ-Ni+γ'-$Ni_3Al$. The oxidation resistant region may be formed on the substrate surface to impart oxidation and high-temperature degradation resistance to the substrate.

Figure 4:
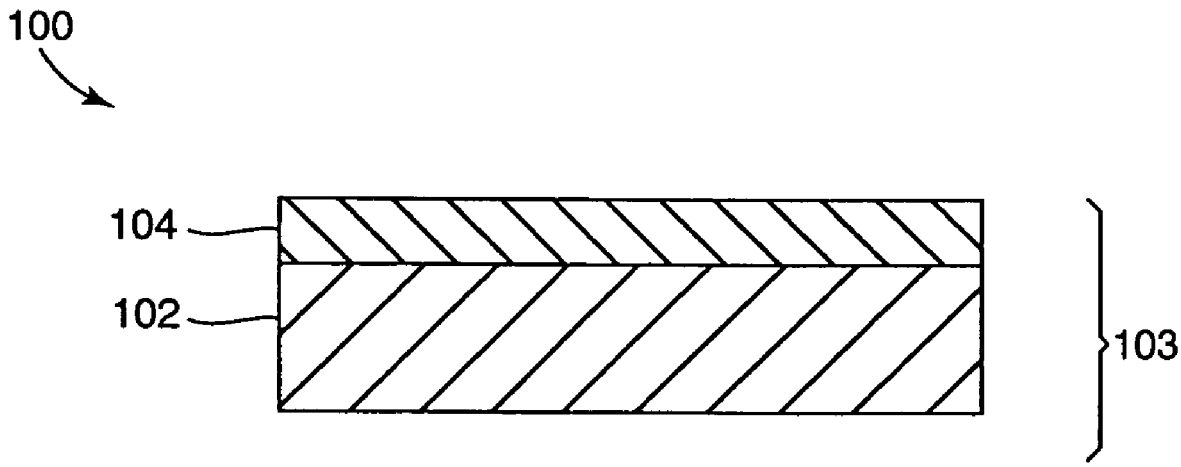
FIG. 4 is a cross-sectional diagram of a metallic article including a Pt-metal group layer.

Referring to FIG. 4, a typical high temperature article 100 includes a Ni or Co-based superalloy substrate 102. Any conventional Ni or Co-based superalloy may be used as the substrate 102, including, for example, those available from Martin-Marietta Corp., Bethesda, Md., under the trade designation MAR-M 002; those available from Cannon-Muskegon Corp., Muskegon, Mich., under the trade designation CMSX-4, CMSX-10, and the like.

Referring again to FIG. 4, the initial step of the method includes depositing a layer of a Pt-group metal 104 on the substrate to form a platinized substrate 103. The Pt-group metal may be selected from, for example, Pt, Pd, Ir, Rh and Ru, or combinations thereof. Pt-group metals including Pt are preferred, and Pt is particularly preferred. The Pt-group metal may be deposited by any conventional technique, such as, for example, electrodeposition. The thickness of the layer 104 of Pt-group metal may vary widely depending on the intended application for the temperature resistant article 100, but typically will be about 3 Tm to about 12 Tm, ±1 Tm, and preferably about 6 Tm. It is preferred that the Pt layer be planar and compact; however, some roughness and porosity can be tolerated.

As the layer of Pt-group metal 104 on the superalloy substrate 102 is heated, elements diffuse from the substrate 102 into the Pt-group metal region 104. This diffusion can continue until a γ-Ni+γ'-$Ni_3Al$ microstructure predominates within the Pt-metal group region 104. Thus, a diffusion heat-treatment preferably follows deposition of the Pt layer. As an example, the heat treatment may be for 1-3 hours at 1000-1200° C. During this heat treatment step, further diffusion occurs from the superalloy substrate 102 into the layer of Pt-group metal 104 to form a Pt-modified surface region in which γ' is the principal phase, most preferably the sole phase. Current experimental data indicates that reactive elements such as Hf, Zr and the like partition almost solely to the γ' phase. As a consequence, the full oxidative benefit of reactive element addition is most readily and easily realized when γ' is the principal phase in the γ-Ni+γ'-$Ni_3Al$ microstructure of the region 104.

Figure 5:
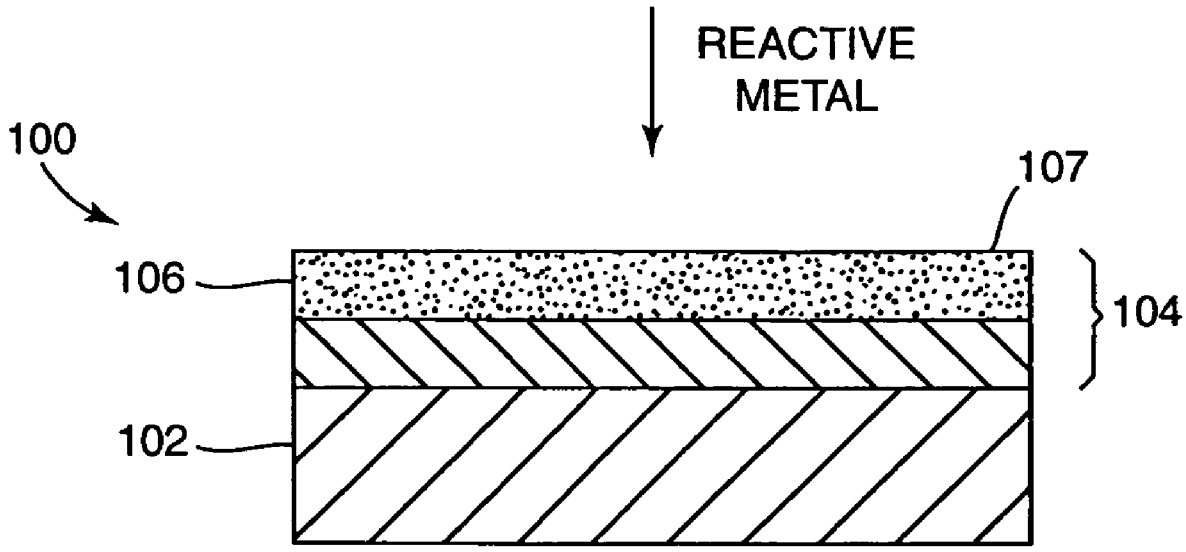
FIG. 5 is a cross-sectional diagram of a metallic article including a Pt-group metal layer having a surface modified region enriched with a reactive metal.

Referring to FIG. 5, a reactive metal is deposited on the surface region 104 to form a surface modified region 106 thereon that is enriched in the reactive metal. Suitable reactive metals include Hf, Y, La, Ce and Zr, or combinations thereof, and Hf is preferred. The reactive metal may be deposited by any conventional process, including physical vapor deposition (PVD) processes such as sputtering and electron beam direct vapor deposition (EBDVD), as well as chemical vapor deposition (CVD) processes such as those in which the reactive metal is deposited using a pack process or in a chamber containing a gas including the reactive metal. The preferred deposition process to form the surface-modified region 106 is a pack or out-of-pack process in which the substrate 102 with the Pt-group metal layer 104 is either embedded in or above a pack including the reactive metal.

In the pack-cementation process, for example, the substrate 102, including the Pt-group metal layer 104, are embedded in a powder mixture containing either a pure or alloyed coating-source material called the master alloy, a halide salt that acts as an activator, and a filler material.

During the deposition process, the powders in the pack are heated to an elevated deposition temperature, which produces a halide gas containing the reactive metal. When the Pt-group metal layer 104 is exposed to the reactive-metal-containing gas, the gas reacts with the layer 104, and the reactive metal deposits on the layer 104 to form a diffusion coating referred to herein as the surface modified region 106.

The composition of the surface modified region 106 is directly dependent on the composition of the powders in the pack. The pack powder composition preferably includes a filler, an activator and a master alloy source, and many compositions are possible. However, the pack powder composition should contain a sufficient amount of the master alloy source such that the reactive metal deposits on the Pt-group metal layer 104 and forms a surface-modified region 106 having the desired concentration of reactive metal. Preferably, the surface modified region 106 includes an average of up to about 5 wt % reactive metal, preferably about 0.8 wt % to about 5 wt %, and most preferably about 0.8% to about 3 wt %.

To achieve these concentrations of reactive metal in the region 106, typically the master alloy source includes at least about 1 wt % of a reactive metal, preferably Hf, and is present in the pack at a content of about 1 wt % to about 5 wt % Hf, but most preferably about 3 wt % Hf. A salt containing one or more of reactive-elements may be an alternative source, such as, for example, hafnium chloride. The master alloy source may optionally include about 0.5 wt % to about 1 wt % Al to provide surface enrichment of the Pt-metal layer 104.

The pack powder composition also includes about 0.5 wt % to about 4 wt %, preferably about 1 wt %, of a halide salt activator. The halide salt may vary widely, but ammonium halides such as ammonium chloride and ammonium fluoride are preferred.

The balance of the pack powder composition, typically about 94 wt %, is a filler that prevents the pack from sintering and to suspend the substrate during the deposition procedure. The filler typically is a minimally reactive oxide powder. Again, the oxide powder may vary widely, but compounds such as aluminum oxide, silicon oxide, yttrium oxide and zirconium oxide are preferred, and aluminum oxide ($Al_2O_3$) is particularly preferred to provide additional Al surface enrichment to Pt-metal layer 104.

The pack powder composition is heated to a temperature of about 65° C. to about 1100° C., preferably less than about 800° C., and most preferably about 750° C., for a time sufficient to produce a surface-modified region 106 with the desired thickness and reactive metal concentration gradient. The deposition time typically is about 0.5 hours to about 5 hours, preferably about 1 hour.

As the reactive metal and any other metals in the pack composition are deposited on the Pt-metal layer 104, diffusive mixing occurs at the surface of the layer 104 to form the surface modified region 106. The reactive metal, preferably Hf, as well as any other metals in the pack, such as Al, diffuse into and mix to form an Al-enriched Pt+reactive-metal modified K-Ni+K'-$Ni_3Al$ surface region 106. This surface-modified region 106 is therefore enriched in the metals from the pack. Within the surface-modified region 106, the concentration of reactive metal is greatest at the surface 107, and gradually decreases over the thickness of the layer 106, thus forming a reactive metal concentration gradient across the thickness of the layer 106.

The surface-modified region 106 typically has a thickness of about 5 Tm to about 50 Tm, preferably about 20 Tm. Over the first 20 Tm, the surface-modified region 106 has a composition including at least about 1 wt % of the reactive metal, preferably Hf, typically about 1 wt % Hf to about 3 wt % Hf.

During and after the deposition process, in addition to the inward diffusion from the surface modified region 106 into the Pt-group metal layer 104, metals also diffuse outward from the superalloy substrate 102 into the Pt-group metal layer 104 and further into the surface modified region 106. For example, a superalloy substrate 102 such as CMSX-4 nominally contains at least about 12 at % Al. The Al in the substrate diffuses into the Pt-group metal layer 104 and into the surface modified region 106. In addition, other elements from the superalloy substrate, such as, for example, Cr, Co, Mn, Ta, and Re may diffuse outward from the superalloy substrate 102 into the Pt-group metal layer 104 and then into the surface modified region 106. Further, if other metals such as Al are included in the pack, Al deposited along with the reactive metal layer may diffuse inward into the surface modified region 106 and into the Pt-group metal layer 104.

The composition of the pack is selected considering these outward and inward diffusive mixing behaviors, and it is important that while a variety of metals may be present in the surface modified region 106, the Al content of the region 106 is preferably controlled with respect to concentration of the Pt-group metal, Ni, and reactive element such that a K-Ni+K'-$Ni_3Al$ phase constitution results, with K'-$Ni_3Al$ being the principal or even sole phase. In the region 106 the concentration of Al is limited with respect to the concentration of Ni, the Pt-group metal and the reactive element such that substantially no θ-NiAl phase structure, preferably no θ-NiAl phase structure, is present in the region, and the K-Ni+K'-$Ni_3Al$ phase structure predominates.

As a result of this extensive diffusive mixing, the amount of metallic Al as the master alloy source in the pack composition is preferably maintained at a very low level, less than about 1 wt %. Even master alloy sources including 0 wt % Al have been found to produce a K-Ni+K'-$Ni_3Al$ phase, particularly if the filler material includes at least some $Al_2O_3$ powder. The main source for Al in the surface modified region 106 can be the superalloy substrate 102, not the pack. Specifically, the chemical interaction between Al and Pt is such that a strong driving force exists for the Al to diffuse from the substrate 102 into Pt-group metal layer 104 and further into the surface modified region 106. Pack compositions with metallic Al concentrations of greater than about 1 wt % typically result in θ-NiAl phase formation in the surface modified region 106, and often result in the formation of W-rich TCP precipitates therein.

The thickness of the Pt-group metal layer 104 also has an impact on the diffusive mixing behavior in the article 100, as well as on the composition of the surface modified region 106. For example, if the Pt-group metal layer 104 has a thickness of about 2 Tm, the surface modified layer 106 most likely will have a Pt-group metal modified K+K' coating with a primary K phase, while a Pt-group metal layer with a thickness greater than about 4 Tm, typically about 4 Tm to about 8 Tm, will most likely have a Pt-group metal modified K+K' coating with a primary K' phase.

The temperature used in the pack cementation process also has an impact on the phase constitution of the surface modified layer 106. At higher temperatures, particularly when Al powder is included in the master alloy source, the amount of Al deposited along with the reactive metal becomes sufficiently high to produce unwanted θ-NiAl phase structure in the surface modified region 106. Typically, a pack cementation temperature of about 900° C. resulted in some θ-NiAl phase formation. Therefore, to reduce formation of θ-NiAl phase structure in the surface modified region 106, the pack cementation temperature should preferably be maintained at less than about 800° C., preferably about 750° C.

Following the deposition process, the article 100 is preferably cooled to room temperature, although this cooling step is not required.

Following formation of the surface-modified region 106, the article 100 may optionally be heat treated at a temperature of about 900° C. to about 1200° C. for up to about 6 hours to stabilize the microstructure of the surface modified layer 200. The optional heat treatment step may be conducted prior to or before the article 100 is cooled to room temperature.

Figure 6:
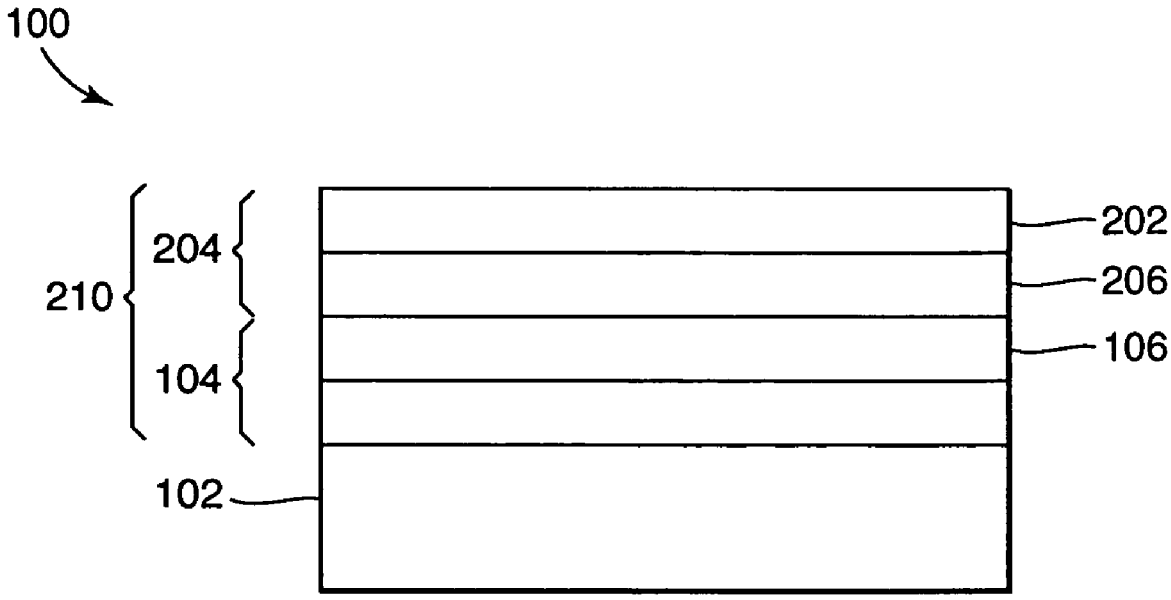
FIG. 6 is a cross-sectional diagram of a metallic article of FIG. 5 with a thermal barrier coating.

Referring to FIG. 6, a layer of ceramic 202, typically consisting of partially stabilized zirconia, may optionally be applied to the surface modified region 106 using a conventional PVD process to form a ceramic topcoat 204. Suitable ceramic topcoats are available from, for example, Chromalloy Gas Turbine Corp., Delaware, USA. The deposition of the ceramic topcoat 204 conventionally takes place in an atmosphere including oxygen and inert gases such as argon. The presence of oxygen during the ceramic deposition process makes it inevitable that a thin oxide scale layer 206 is formed on the surface of the surface-modified region 106. The thermally grown oxide (TGO) layer 206 includes alumina and is typically an adherent layer of I-$Al_2O_3$. The bond coat layer 106, the TGO layer 206 and the ceramic topcoat layer 204 form a thermal barrier coating 210 on the superalloy substrate 102.

Preferred embodiments of the invention will now be described with reference to the following examples.

EXAMPLES

Example 1

An electrodeposition bath was prepared using a tetraamineplatinum hydrogen phosphate solution ($[Pt(NH_3)_4]HPO_4$). The superalloy substrate was CMSX-4 with approximate dimensions 15×10×1 mm.

The superalloy substrate sample was prepared by grinding to a 600-grit finish using SiC paper, followed by cleaning using the following procedure. First the sample was dipped in distilled water and dried with a tissue. The sample was then dipped in a 10 wt. % HCl solution for 2 minutes, dipped in distilled water and dried with a tissue. Finally, the sample was ultrasonically cleaned in acetone for 5 minutes and dipped in distilled water.

The prepared sample was then electrodeposited immediately. The electrodeposition conditions were as follows:

Current density≈0.5 A/dm$^2$
Temperature≈95° C.
pH≈10.5 (adjusted using NaOH)
Deposition time=0.5 hour
Distance between anode and cathode≈5 cm
Anode: Pt
Anode:cathode surface area ratio≈2

To produce a Pt+Hf-modified K-Ni+K'-$Ni_3Al$ coating in which K' was the principal phase, packs consisting of Hf powder and with/without Al powder were assessed. The basis for using no Al powder in the pack is that Al from the superalloy substrate will be driven to diffuse outward to the Pt-enriched surface, since Pt decreases the chemical activity of Al in K and K' phase structures.

Using a pack deposition temperature of 750 or 800° C. and an $NH_4Cl$ activator content of about 1 wt %, it was found that Pt+Hf-modified coatings can be obtained. The following section will discuss the effects of specific experimental parameters on the microstructure and composition of Pt+Hf-modified coatings.

Thickness of Electrodeposited Pt Layer

Figure 7B:
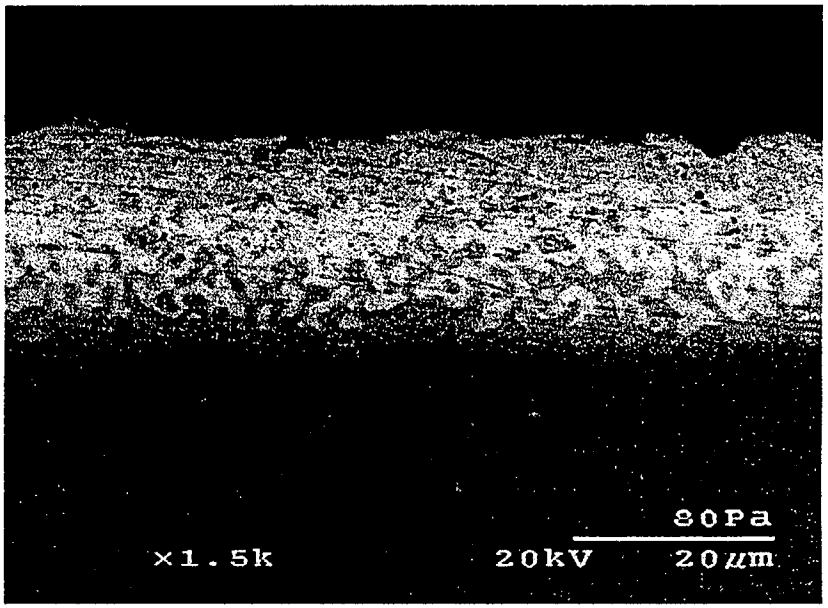
FIGS. 7A and 7B are cross-sectional images of Pt-modified K-Ni+K'-$Ni_3Al$ coatings obtained by heat treating a CMSX-4 superalloy substrate having Pt-layers of differing thicknesses.
Figure 7A:
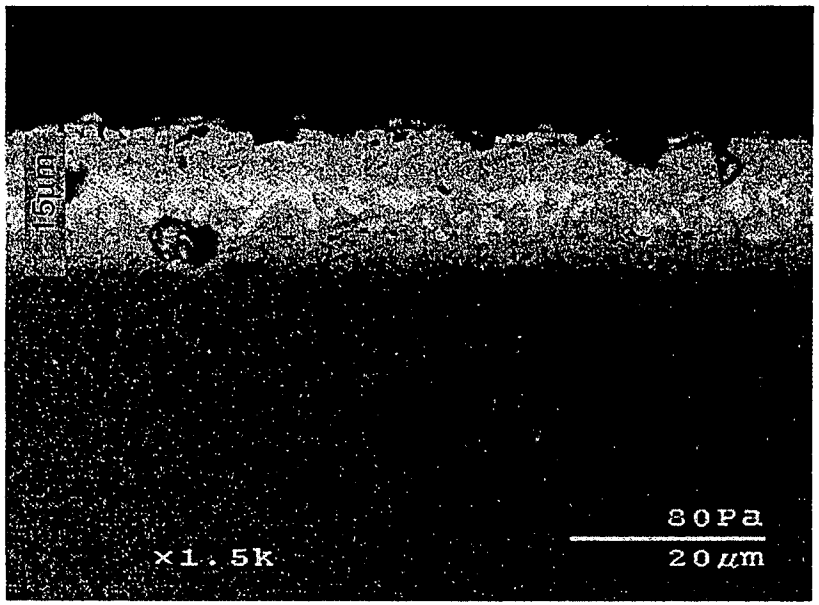

By heat treating the Pt-coated sample, a simple Pt-modified coating can be obtained via inward Pt and outward Al+Ni diffusion. It was found that the thickness of deposited Pt layer affects the coating microstructure, composition and relative proportions of K and K'. FIG. 7 shows the coatings obtained by heat-treating CMSX-4 samples having different electrodeposited Pt-layer thicknesses. Referring to FIG. 7A, it is seen that a thin Pt layer (about 2 μm) resulted in a Pt-modified K and K' coating with K being the primary phase. By contrast, as shown in FIG. 7B, a Pt modified K and K' coating in which K' is the primary phase formed from a thicker Pt layer (about 7 μm).

Al Content in Pack

The amount of aluminum powder in the pack will affect the extent of aluminum intake into the substrate. CMSX-4 nominally contains about 12 at % Al, which could also diffuse outward to the Pt-enriched surface during heat-treatment. Thus, it was deemed that only small amount of Al is required to obtain coating with about 22 at % Al by the pack cementation process.

Figure 1:
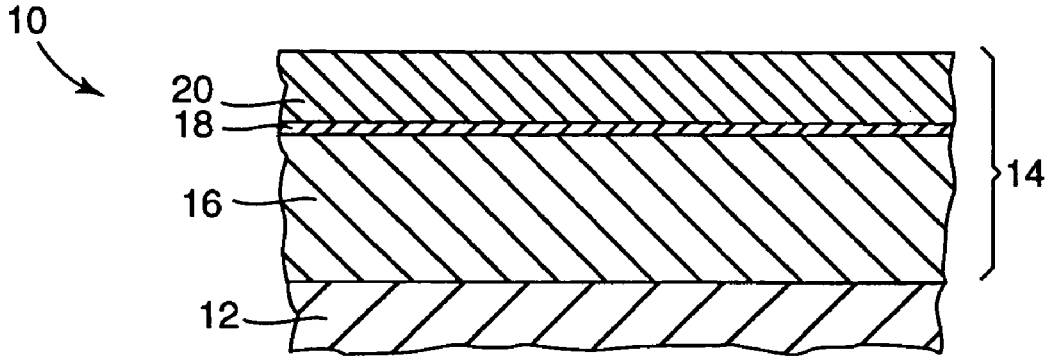
FIG. 1 is a cross-sectional diagram of a metallic article with a thermal barrier coating.
Figure 2A:
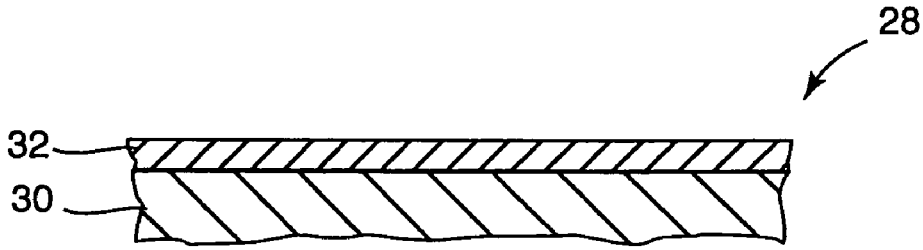
FIG. 2A is a cross-sectional diagram of a metallic article coated with a Pt layer, prior to heat treatment.
Figure 2B:
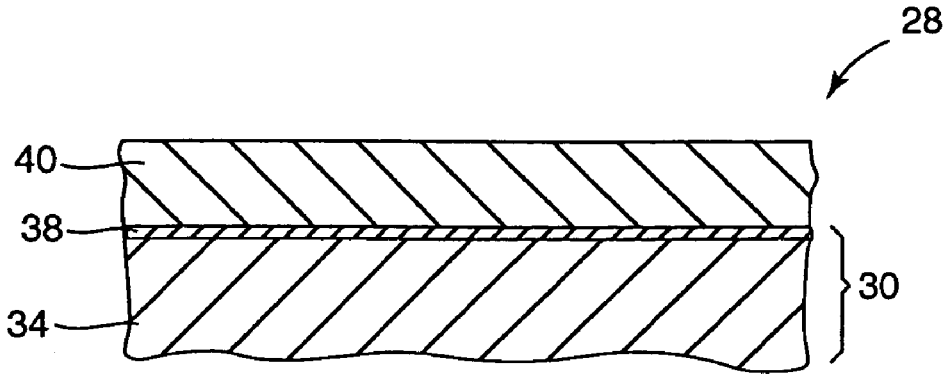
FIG. 2B is a cross-sectional diagram of the metallic article of FIG. 2A following heat treatment of the superalloy substrate and application of a conventional thermal barrier coating.
Figure 3:
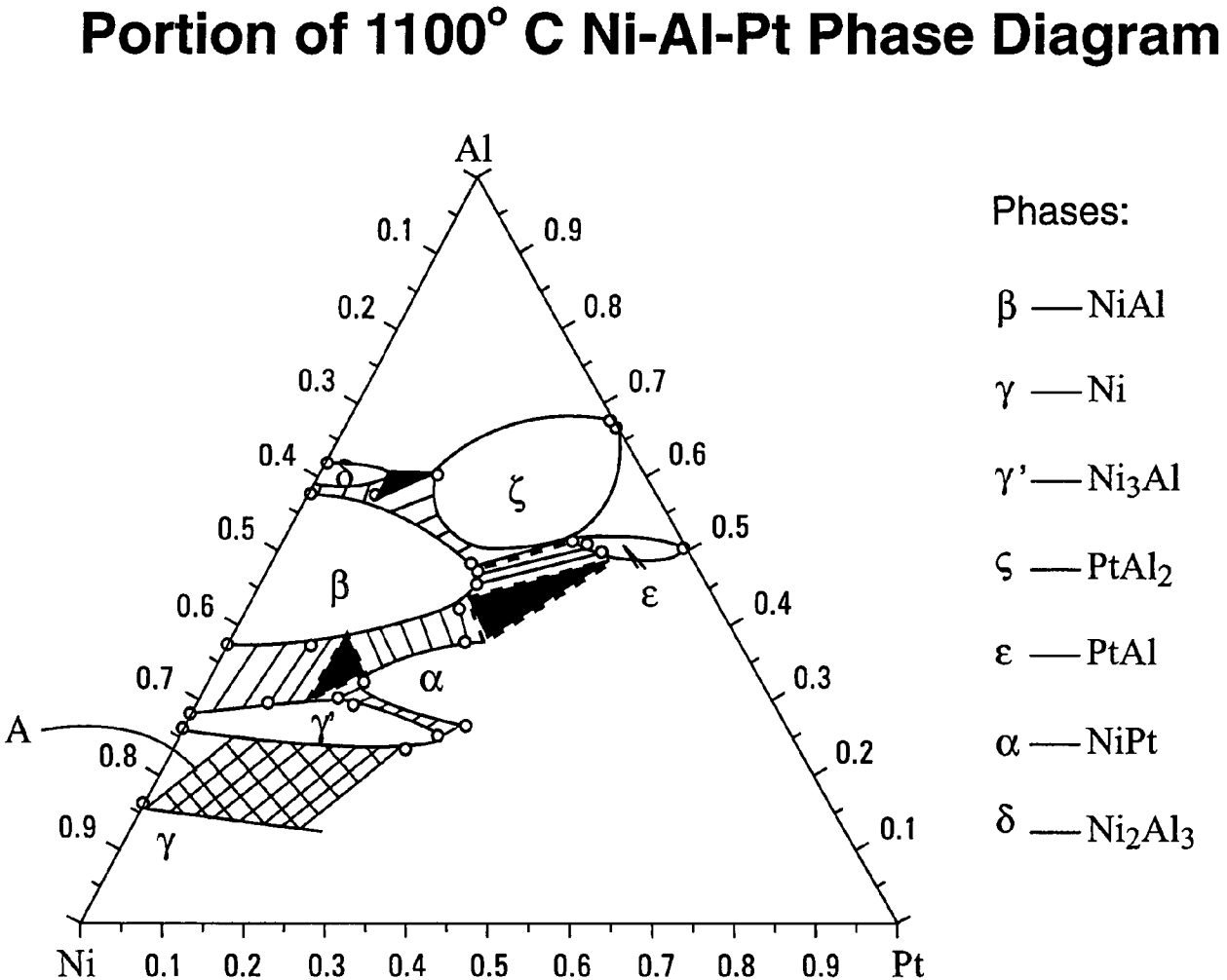
FIG. 3 is a portion of a 1100° C. Ni-Al-Pt phase diagram showing an embodiment of the Pt metal modified K-Ni+K'-$Ni_3Al$ alloy compositions of the invention.
Figure 8A:
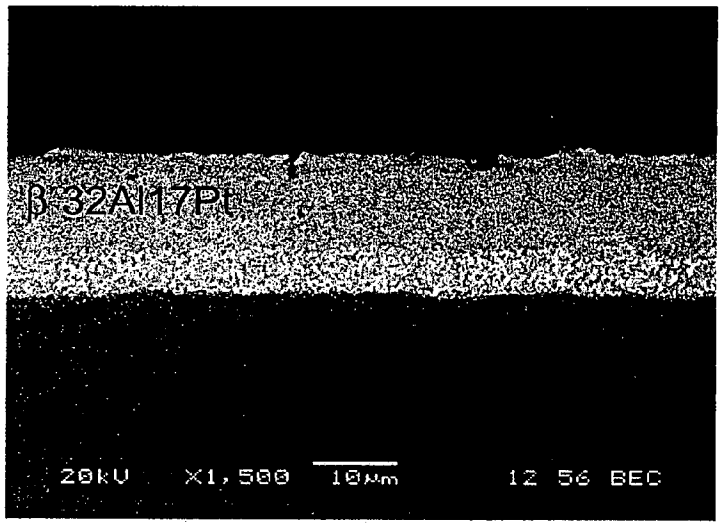
FIGS. 8A, 8B and 8C are cross-sectional images of Pt-modified K-Ni+K'-$Ni_3Al$ coatings obtained by varying the Al content of the chemical vapor deposition pack.
Figure 8B:
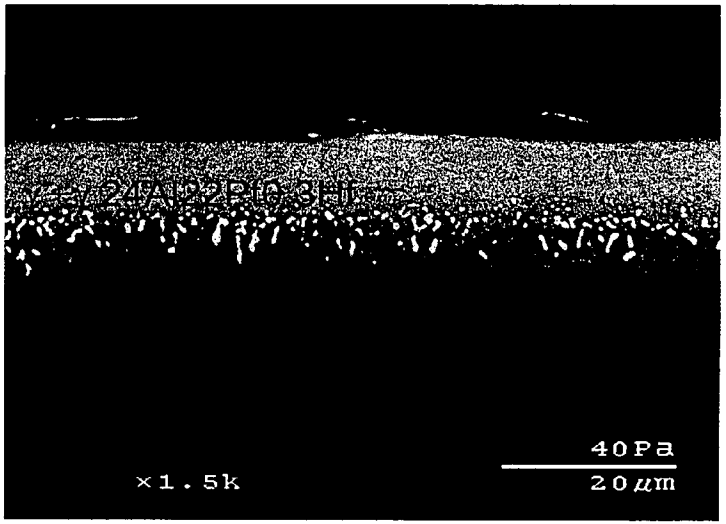

FIG. 8 shows pack cementation results for two slightly different Al powder contents in the pack. The coating process consisted of electrodepositing a Pt layer (~5 μm), aluminizing at 800° C. for 1 hour, and then heat-treating for 1 hour at 1100° C. As shown in FIG. 8A, it was found that 0.5 wt % Al in the pack is enough to produce a K' coating with about 24 at % Al. Referring to FIG. 8B, 1 wt % Al resulted in a θ-NiAl phase structure in the coating. It should be noted that a high Al intake resulted in the formation of W-rich TCP precipitates in the vicinity of the coating/alloy interface.

Figure 8C:
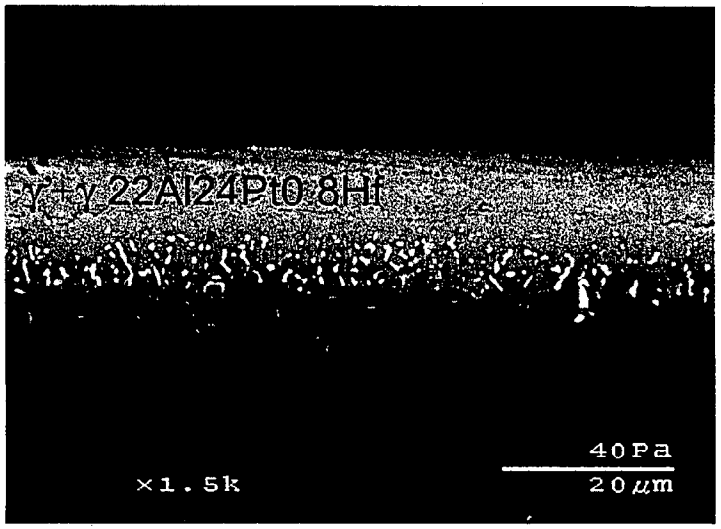

It was found that a Pt-coated CMSX-4 substrate that is further treated in a pack free of Al powder, yet still containing $Al_2O_3$ powder, can form a Pt-modified K'-based surface layer. FIG. 8C shows the coating after pack cementation for 1 hour at 800° C. in a pack containing Hf (5 wt %) and $Al_2O_3$ powders. It is seen that the obtained coating structure is very similar to that shown in FIG. 7B, which was different in pack coating process only by the presence of 0.5 wt % Al in the pack.

Hf Content in the Pack

It is known that Hf partitions to the K' phase, and there must ultimately exist a critical Hf content in the pack to obtain a sufficiently high Hf deposition rate. From this study, it was found that 5 wt % Hf in the pack resulted in a detectable Hf content (above about 0.3 at %) in the K+K' coating (see FIG. 8C). A K'-based coating containing above 1 at. % Hf was deposited by controlling the hafnizing conditions.

Temperature of Pack Cementation Process

Figure 9B:
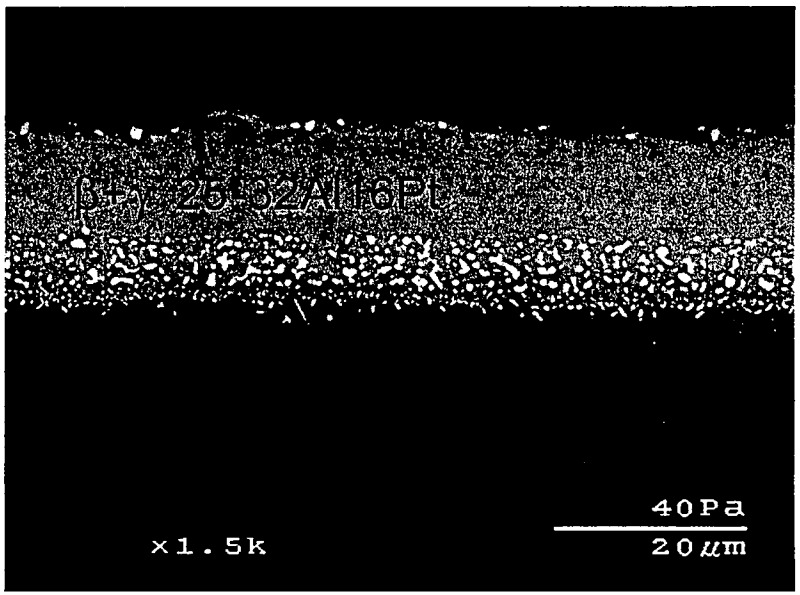
FIGS. 9A and 9B are cross-sectional images showing the effect of heat treatment temperature on Pt-modified K-Ni+K'-$Ni_3Al$ coatings.
Figure 9A:
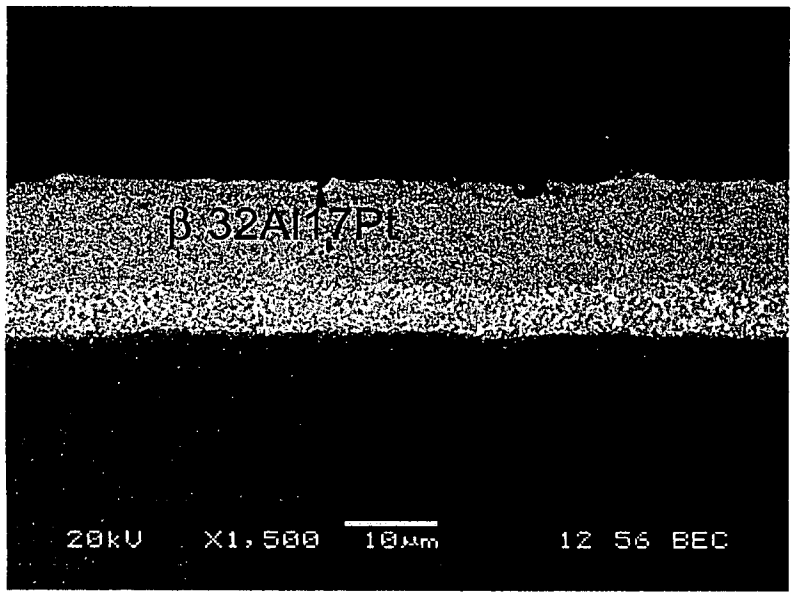

Temperature is a factor in determining the extent of Al deposition. At higher temperatures and using ~1 wt % Al in the pack, the supply of Al becomes sufficiently high for unwanted (from the standpoint of obtaining a K+K' coating) θ-NiAl formation. An aluminizing temperature above ~900° C. resulted in dense θ-NiAl formation, which was hard to transform to K' phase with heat-treatment, such as 1-4 days heat-treatment at 1100° C. FIG. 9 shows the Pt-modified θ-NiAl coatings obtained on CMSX-4 samples after 1-hour heat-treatment at either 1100° C. (FIG. 9A) or 1150° C. (FIG. 9B). The samples were first electrodeposited with a ~5 μm Pt layer, followed by pack aluminizing (3 wt % Hf, 1 wt % Al, 1 wt % $NH_4Cl$, and $Al_2O_3$-balance) and then a final heat-treatment. Further heat-treatment was found to result in a larger amount of W-rich precipitates in the interdiffusion zone. Moreover, θ persisted with further heat treatment. Thus, in order to avoid obtaining θ phase, the aluminizing or hafnizing temperatures should preferably be kept below about 800° C.

Example 2

Figure 10:
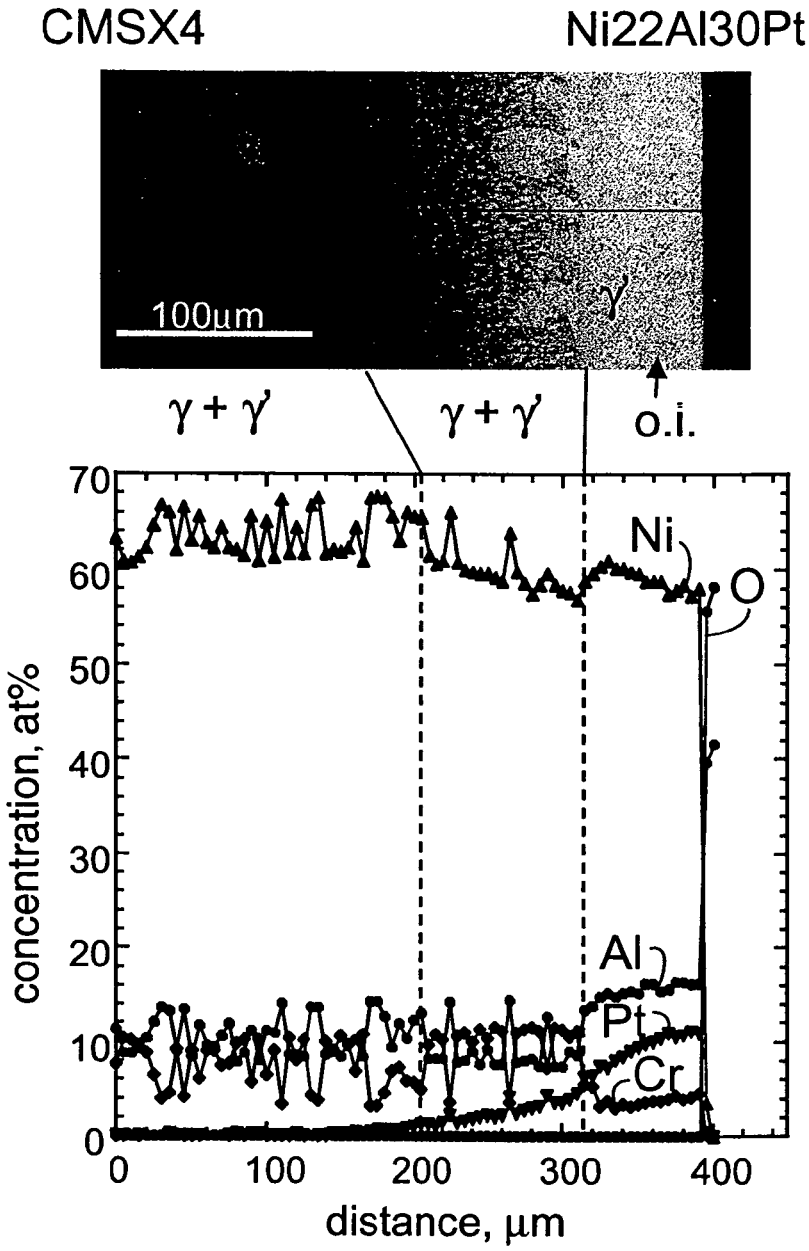
FIG. 10 is a plot showing the oxidation behavior of a Ni22Al30Pt alloy coating on aCMSX-4 superalloy substrate.

Referring to FIG. 10, a thin layer (about 60 microns) of a Ni-Al-Pt alloy is diffusion bonded to a CMSX-4 superalloy substrate. The layer is seen to have excellent oxidation resistance, as well as excellent compatibility with the superalloy substrate.

Example 3

Figure 11:
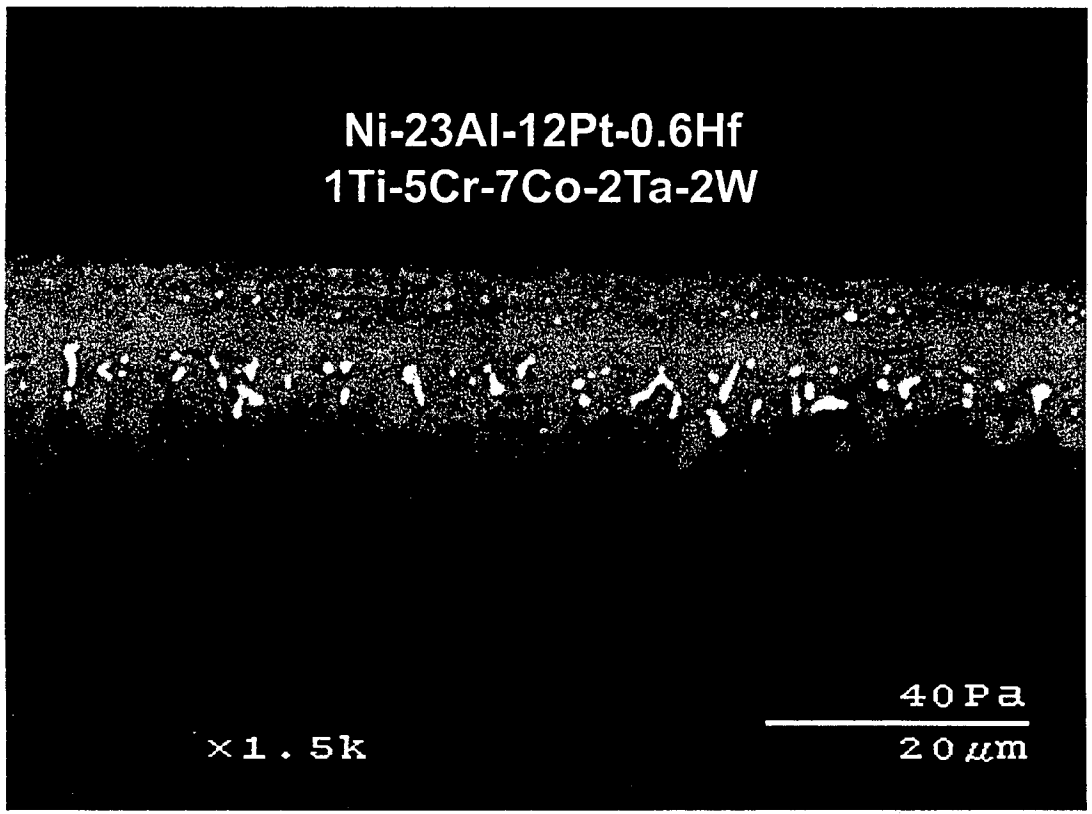
FIG. 11 is a cross-sectional image of a reactive metal modified K-Ni+K'-$Ni_3Al$ coating on a CMSX-4 superalloy substrate.
Figure 12:
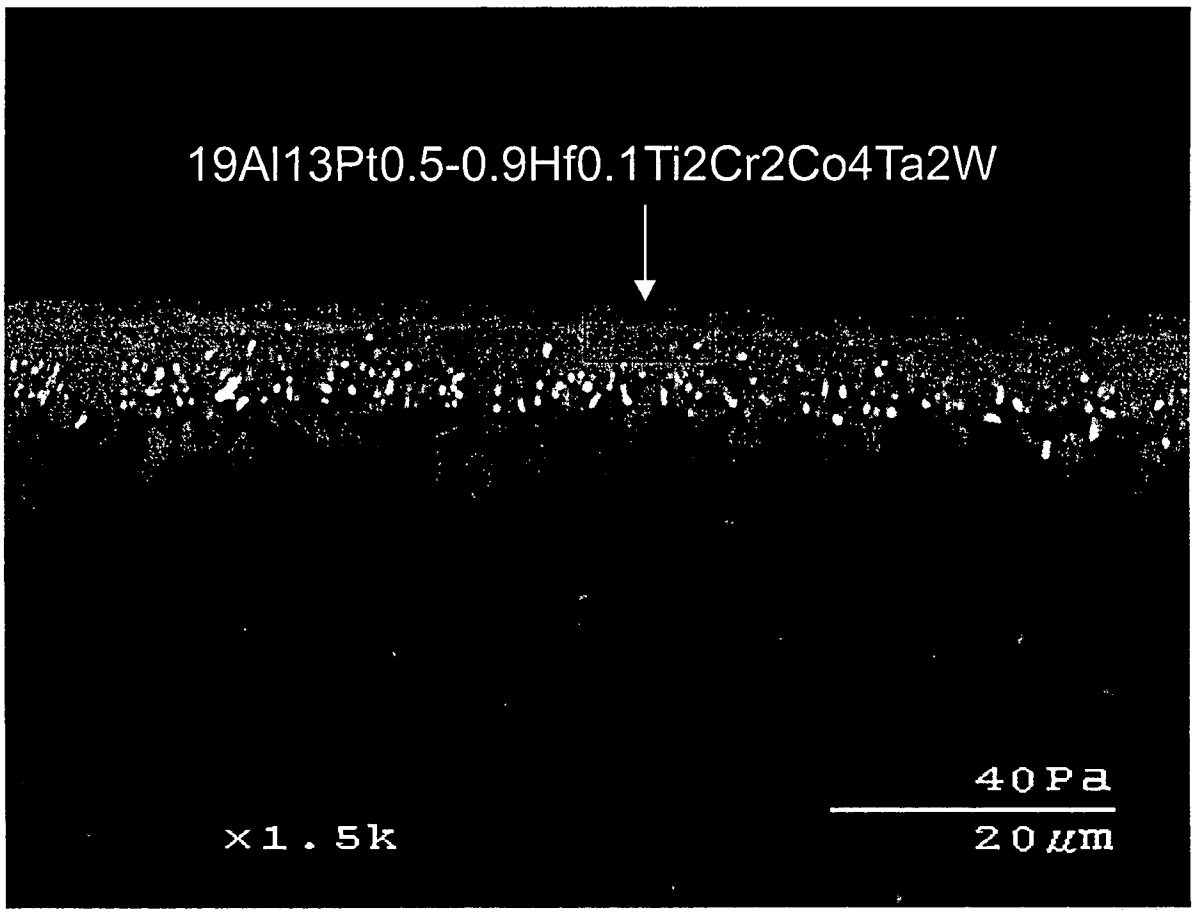
FIG. 12 is a cross-sectional image of a reactive metal modified K-Ni+K'-$Ni_3Al$ coating on a CMSX-10 superalloy substrate.

FIGS. 11-12 show a reactive metal modified Ni-Al-Pt coating on two different superalloy substrates, CMSX-4 (FIG. 11) and CMSX-10 (FIG. 12). These coatings have minimal topologically close-packed (tcp) phase formation in the interdiffusion zone (i.e., the coating-to-base alloy transition zone).

Example 4

Figure 13:
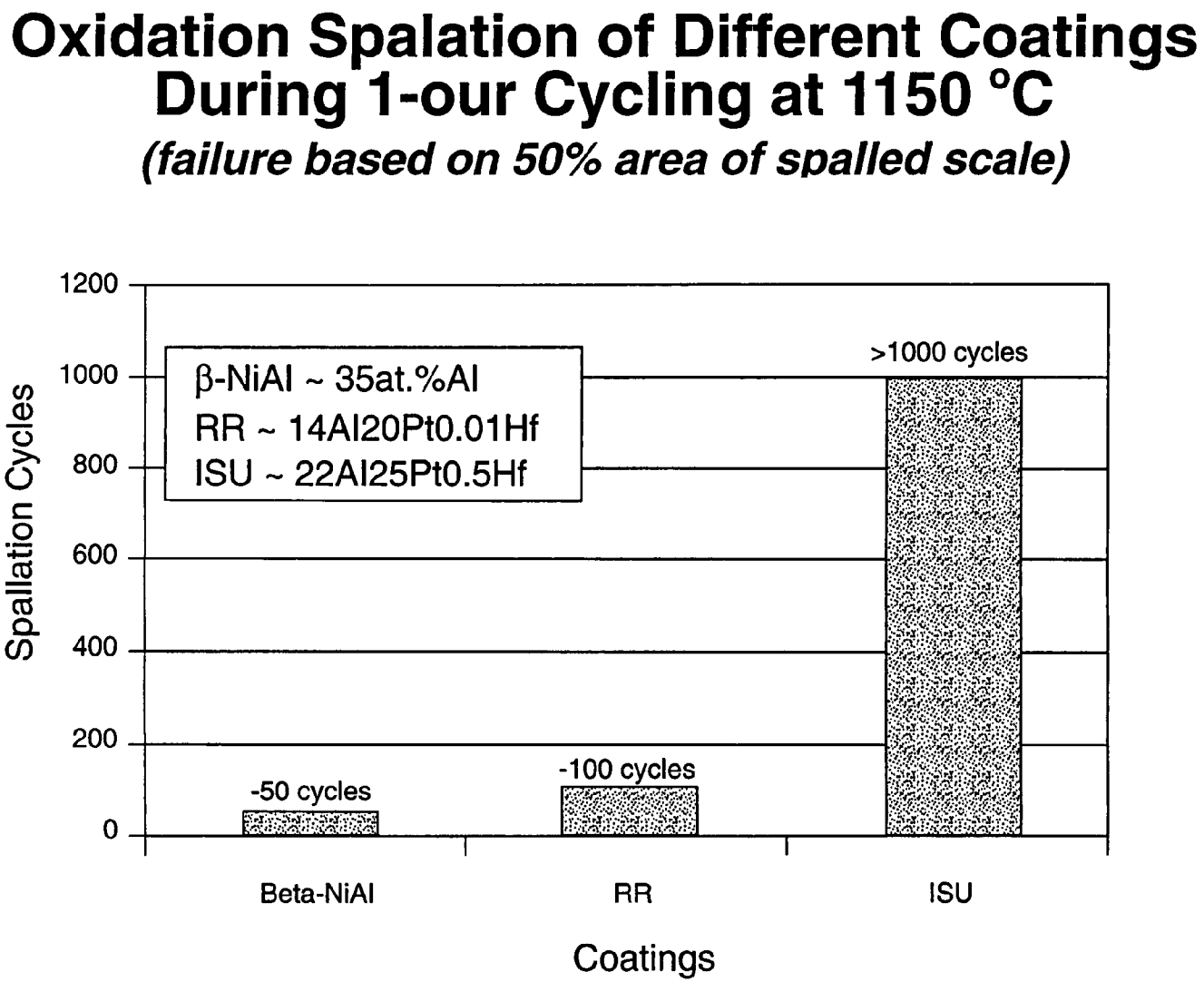
FIG. 13 is a plat showing the oxidation spallation of reactive metal modified K-Ni+K'-$Ni_3Al$ coatings at 1150° C.

FIG. 13 shows the excellent oxidation resistance that can be gained by using a reactive metal modified Ni-Al-Pt coating with an enhanced concentration of reactive metal. The plot compares a β-NiAl coating, a reactive metal modified Ni-Al-Pt coating having 0.01 at % Hf (RR) and a coating with a reactive metal modified Ni-Al-Pt coating having 0.5 at % Hf (ISU). The coating ISU resisted spallation for over 1000 cycles, compared to about 50 cycles for the β-NiAl coating and 100 cycles for the RR coating.

Example 5

Figure 14:
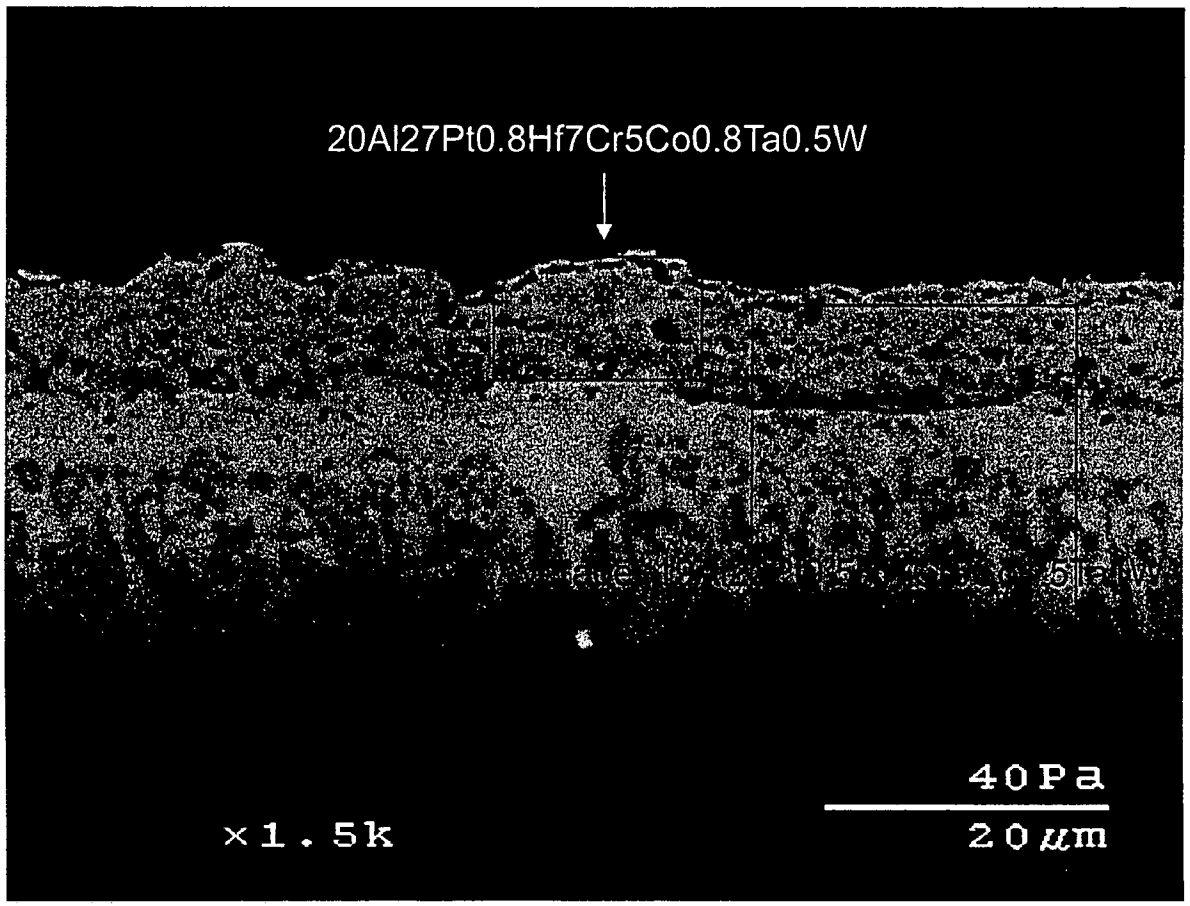
FIG. 14 is a cross-sectional image of a reactive metal modified K-Ni+K'-$Ni_3Al$ coating on a Rene-N5 superalloy substrate.
Figure 15:
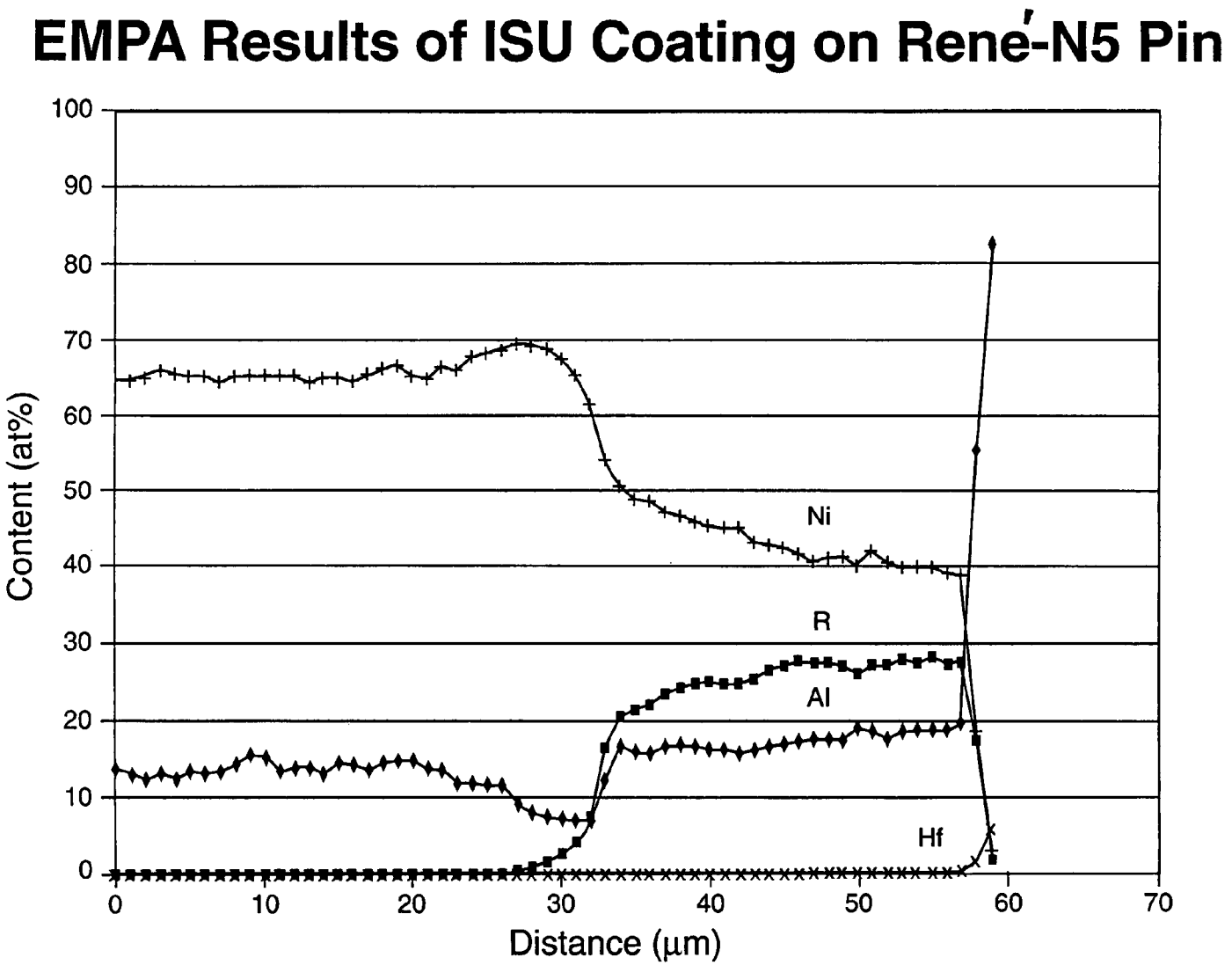
FIG. 15 is a plot of an EPMA analysis of the coating of FIG. 14.

FIG. 14 shows a reactive metal modified Ni-Al-Pt coating according to an embodiment of the invention applied on a Ni-based Rene-N5 superalloy substrate. FIG. 15 shows the composition profile through the coating of FIG. 14 as measured using electron probe microanalysis (EPMA). The EPMA plot of FIG. 15 shows that Hf is particularly enriched at the coating surface.

A number of embodiments of the invention have been described. Nevertheless, it will be understood that various modifications may be made without departing from the spirit and scope of the invention. Accordingly, other embodiments are within the scope of the following claims.

What is claimed is:

1. A method for making an oxidation resistant article, comprising:

(a) providing a superalloy substrate comprising Ni and Al;

(b) depositing a layer of a Pt group metal on the superalloy substrate to form a Pt group metallized substrate;

(c) depositing on the Pt group metallized substrate by a chemical vapor deposition (CVD) process at least one reactive element selected from the group consisting of Hf, La, Ce, and Zr to form a surface modified region thereon, wherein the surface modified region comprises the Pt-group metal, Ni, Al and the reactive element in relative concentration to provide a γ-Ni+γ'-$Ni_3Al$ phase constitution, and wherein the surface modified region comprises an average of about 1 wt. % to about 5 wt. % of the reactive element.

2. The method of claim 1, wherein γ'-$Ni_3Al$ is the primary phase in the surface modified region.

3. The method of claim 1, further comprising heat treating the Pt group metallized substrate prior to step (c).

4. The method of claim 3, wherein the Pt group metallized substrate is heat treated for about 1 to about 3 hours at a temperature of about 1000° C. to about 1200° C.

5. The method of claim 3, wherein γ'-$Ni_3Al$ is the primary phase in the surface modified region.

6. The method of claim 1, wherein the Pt group metal is Pt.

7. The method of claim 6, wherein the layer of Pt group metal has a thickness of about 3 μm to about 12 μm.

8. The method of claim 6, wherein the reactive element is selected from the group consisting of Hf, Zr and combinations thereof.

9. The method of claim 6, wherein the reactive element is Hf.

10. The method of claim 1, further comprising diffusing from the substrate into the surface modified region a metal selected from the group consisting of Cr, Co, Mo, Ta, and Re, and combinations thereof.

11. The method of claim 1, wherein the reactive element is deposited from a pack, and wherein the pack is at a temperature of bout 650° C. to about 1100° C.

12. The method of claim 1, wherein the reactive element is deposited from a pack, and wherein the pack is at a temperature of about 750° C.

13. The method of claim 1, wherein the reactive element is deposited over a period of about 0.5 hours to about 5 hours.

14. The method of claim 1, wherein the reactive element is deposited over a period of about 1 hour.

15. The method of claim 1, wherein the reactive element is deposited from a pack, and wherein the pack is at a temperature of about 750° C. for a deposition period of about 1 hour.

16. The method of claim 1, further comprising cooling the article to room temperature following step (c).

17. The method of claim 16, further comprising heat treating the article at a temperature of about 900° C. to about 1200° C. for up to about 6 hours following cooling the article to room temperature.

18. The method of claim 1, further comprising heat treating the article following step (c) at a temperature of about 900° C. to about 1200° C. for up to about 6 hours.

19. A method of making a temperature resistant article, comprising:

(a) providing a superalloy substrate comprising Ni and Al;

(b) depositing a layer of Pt on the superalloy substrate to form a platinized substrate;

(c) heat treating the platinized substrate;

(d) providing a pack comprising a source and a filler, wherein the source comprises Al and a reactive element selected from the group consisting of Hf and Zr and combinations thereof; and (e) depositing from the pack at a temperature of less than about 800° C. onto the platinized substrate to form a surface modified region thereon, wherein the surface modified region comprises Pt, Ni, Al and the reactive element in relative concentration to provide a γ-Ni+γ'-$Ni_3Al$ phase constitution, and wherein the surface modified region comprises an average of about 1 wt. % to about 5 wt. % of the reactive element.

20. The method of claim 19, wherein the filler comprises an oxide powder selected from the group consisting of aluminum oxide, silicon oxide, yttrium oxide and zirconium oxide.

21. The method of claim 20, wherein the filler is aluminum oxide.

22. The method of claim 19, wherein the pack further comprises an activator comprising a halide salt selected from the group consisting of ammonium chloride, ammonium fluoride and combinations thereof.

23. The method of claim 22, wherein the halide salt is ammonium chloride.

24. The method of claim 19, wherein the source comprises an amount of the reactive element sufficient to provide the surface modified region with greater than 1 wt. % to 3 wt. % of the reactive element.

25. The method of claim 24, wherein the reactive element is Hf.

26. The method of claim 19, wherein the source comprises about 0.5 wt. % to about 1 wt. % metallic Al.

27. The method of claim 19, wherein the reactive element is deposited at a pack temperature of about 750° C.

28. The method of claim 19, wherein the reactive element is deposited over a period of about 0.5 hours to about 5 hours.

29. The method of claim 19, wherein the reactive element is deposited over a period of about 1 hour.

30. The method of claim 19, wherein the reactive element is deposited at a pack temperature of about 750° C. for a deposition period of about 1 hour.

31. The method of claim 19, wherein the platinized substrate is heat treated in step (c) to a temperature of about 1000° C. to about 1200° C. for 1-3 hours.

32. The method of claim 19, further comprising heat treating the article following step (e) at a temperature of about 900° C. to about 1200° C. for up to about 6 hours.

33. The method of claim 19, wherein $\gamma'$-$Ni_3Al$ is the primary phase in the surface modified region.

34. A method of making a temperature resistant article, comprising:

(a) depositing a layer of Pt on a superalloy substrate to form a platinized substrate, wherein the superalloy substrate comprises Ni and Al;

(b) heat treating the platinized substrate; and (c) depositing from a pack at a temperature of less than about 800° C. onto the platinized substrate to form a surface modified region thereon, wherein the pack comprises a source and a filler, and wherein the source comprises sufficient Hf and Al such that the surface modified region comprises Pt, Ni, Hf and Al in relative concentration to provide a $\gamma$-Ni+$\gamma'$-$Ni_3Al$ phase constitution, wherein the surface modified region comprises an average of about 1 wt. % to about 5 wt. % Hf.

35. The method of claim 34, wherein the source comprises 0.5 wt. % to 1 wt. % metallic Al.

36. The method of claim 34, wherein the deposition in step (c) is conducted at a temperature of about 750° C.

37. The method of claim 36, wherein the deposition is conducted over a period of about 0.5 hours to about 5 hours.

38. The method of claim 36, wherein the deposition is conducted over a period of about 1 hour.

39. The method of claim 34, further comprising cooling the article to room temperature following step (c).

40. The method of claim 34, further comprising heat treating the article following step (c) to a temperature of about 900° C. to about 1200° C. for up to about 6 hours.

41. The method of claim 34, wherein the platinized substrate is heat treated in step (b) to a temperature of about 1000° C. to about 1200° C. for 1-3 hours.

42. The method of claim 34, wherein $\gamma'$-$Ni_3Al$ is the primary phase in the surface modified region.

43. A method for making an oxidation resistant article, comprising:

(a) providing a superalloy substrate comprising Ni and Al;

(b) depositing a layer of a Pt group metal on the superalloy substrate to form a Pt group metallized substrate;

(c) providing a gas comprising at least one reactive element selected from the group consisting of Hf, La, Ce, Cr and combinations thereof; and (d) reacting the gas with the Pt group metallized substrate to form a surface modified region thereon, wherein the surface modified region comprises the Pt-group metal, Ni, Al and the reactive element in relative concentration to provide a $\gamma$-Ni+$\gamma'$-$Ni_3Al$ phase constitution, and wherein the surface modified region comprises an average of 1 wt. % to about 5 wt. % of the reactive element.

44. The method of claim 43, wherein $\gamma'$-$Ni_3Al$ is the primary phase in the surface modified region.

45. The method of claim 43, further comprising heat treating the Pt group metallized substrate prior to step (c).

46. The method of claim 45, wherein the Pt group metallized substrate is heat treated for about 1 to about 3 hours at a temperature of about 1000° C. to about 1200° C.

47. The method of claim 43, wherein the Pt group metal is Pt.

48. The method of claim 43, wherein the layer of Pt group metal has a thickness of about 3 μm to about 12 μm.

49. The method of claim 43, wherein the reactive element is Hf.

50. The method of claim 43, further comprising diffusing from the substrate into the surface modified region a metal selected from the group consisting of Cr, Co, Mo, Ta, and Re, and combinations thereof.

51. A method for making an oxidation resistant article, comprising:

(a) providing a superalloy substrate comprising Ni and Al;

(b) depositing a layer of a Pt group metal on the superalloy substrate to form a Pt group metallized substrate;

(c) depositing on the Pt group metallized substrate by a chemical vapor deposition (CVD) process at least one reactive element selected from the group consisting of Hf, La, Ce, and Zr to form a surface modified region thereon, wherein the surface modified region comprises the Pt-group metal, Ni, Al and the reactive element in relative concentration to provide a solely $\gamma$-Ni+$\gamma'$-$Ni_3Al$ phase constitution, and wherein the surface modified region comprises an average of about 1 wt. % to about 5 wt. % of the reactive element.

* * * * *